US010200787B2

(12) United States Patent
Virolainen et al.

(10) Patent No.: US 10,200,787 B2
(45) **Date of Patent: *Feb. 5, 2019**

(54) MIXING MICROPHONE SIGNALS BASED ON DISTANCE BETWEEN MICROPHONES

(71) Applicant: WSOU Investments, LLC, Los Angeles, CA (US)

(72) Inventors: Jussi Virolainen, Espoo (FI); Matti Hamalainen, Lempaala (FI); Joonas Itaranta, Helsinki (FI)

(73) Assignee: WSOU Investments, LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/877,543

(22) Filed: Jan. 23, 2018

(65) Prior Publication Data

US 2018/0160225 A1 Jun. 7, 2018

Related U.S. Application Data

(63) Continuation of application No. 13/875,419, filed on May 2, 2013, now Pat. No. 9,900,686.

(51) Int. Cl.
*H04R 3/00* (2006.01)
*H04R 25/00* (2006.01)

(52) U.S. Cl.
CPC ..... *H04R 3/00* (2013.01); *H04R 25/43* (2013.01); *H04R 2420/01* (2013.01); *H04R 2420/07* (2013.01)

(58) Field of Classification Search
CPC ..... H04R 3/00; H04R 2420/01; H04R 25/43; H04R 2420/07
USPC ..... 381/119, 310, 58, 92
See application file for complete search history.

(56) References Cited

U.S. PATENT DOCUMENTS

2007/0253561 A1* 11/2007 Williams ..... H04S 7/301 381/58
2009/0012779 A1 1/2009 Ikeda et al.
2009/0238377 A1 9/2009 Ramakrishnan et al.
2010/0111329 A1 5/2010 Namba et al.

* cited by examiner

*Primary Examiner* — Vivian Chin
*Assistant Examiner* — Douglas Suthers
(74) *Attorney, Agent, or Firm* — Sean D. Burdick

(57) ABSTRACT

An apparatus including an input configured to receive at least one first audio signal from a first apparatus; an input configured to receive at least one second audio signal from a second apparatus; a distance detector configured to determine a distance between the first and the second apparatus; and a level control generator configured to generate a level control for mixing the at least one first audio signal and the at least one second audio signal based on the distance between the first and the second apparatus.

16 Claims, 9 Drawing Sheets

MIXING MICROPHONE SIGNALS BASED ON DISTANCE BETWEEN MICROPHONES

This patent application is a continuation of and claims priority to U.S. patent application Ser. No. 13/875,419 filed May 2, 2013, the disclosure of which is incorporated by reference herein in its entirety.

FIELD

The present application relates to apparatus for audio signal processing. The invention further relates to, but is not limited to, apparatus for audio signal processing within mobile devices.

BACKGROUND

Spatial audio signals are being used in greater frequency to produce a more immersive audio experience. A stereo or multi-channel output can be generated by a listening apparatus such as headphones, headset, multi-channel loudspeaker arrangement.

Furthermore communication between devices or apparatus has enabled multi-device audio capture, where an audio signal output is generated from the output of more than one microphone on more than one device. Typically in multi-device audio capture, one device works as main (or host) device which captures audio (and in some situations video) while at least one other (or remote) device or accessory work as remote auxiliary microphones.

There are many situations where multi-device audio capture is beneficial. For example environments where background/ambient noise level is high as it may be possible to capture audio signals nearer the desired audio source or sources. For example a person located away from the master or host device who is talking can by using a remote microphone capture or record the voice with much better quality than the host or master device located further away. The remote device can then pass the recorded audio which can be used in whatever way required, for example presenting to the user of the host device, storing on the host device, transmitting to a further device to be used etc.

SUMMARY

Aspects of this application thus provide an audio capture and processing whereby distances between audio signals, correlation between audio signals and noise interference experienced by the audio signals to be mixed can be compensated for.

According to a first aspect there is provided a method comprising: receiving at least one first audio signal from a first apparatus; receiving at least one second audio signal from a second apparatus; determining a distance between the first and the second apparatus; and generating a level control for mixing the at least one first audio signal and the at least one second audio signal based on the distance between the first and the second apparatus.

The method may further comprise mixing the at least one first audio signal and the at least one second audio signal based on the level control.

The method may further comprise determining a correlation between the at least one first audio signal and the at least one second audio signal.

The method may further comprise synchronising one of the at least one first or at least one second audio signal to the other of the at least one second or at least one first audio signal respectively based on the correlation between the at least one first audio signal and the at least one second audio signal.

Generating a level control for mixing the at least one first audio signal and the at least one second audio signal based on the distance between the first and the second apparatus may further comprise generating a level control for mixing based on the correlation between the first audio signal and the at least one second signal.

The method may further comprise determining a signal to noise ratio of the at least one first audio signal, wherein generating a level control for mixing the at least one first audio signal and the at least one second audio signal based on the distance between the first and the second apparatus may further comprise generating a level control for mixing based on the signal to noise ratio of the at least one first audio signal.

The method may further comprise determining a signal to noise ratio of the at least one second audio signal, wherein generating a level control for mixing the at least one first audio signal and the at least one second audio signal based on the distance between the first and the second apparatus may further comprise generating a level control for mixing based on the signal to noise ratio of the at least one second audio signal.

The method may further comprise determining at least one user input, wherein generating a level control for mixing the at least one first audio signal and the at least one second audio signal based on the distance between the first and the second apparatus may further comprise generating a level control for mixing based on the at least one user input.

Determining a distance between the first and the second apparatus may comprise: determining a location estimation of the first apparatus; determining a location estimation of the second apparatus; determining a distance based on a location difference between the location estimation of the first apparatus and the location estimation of the second apparatus receiving.

Determining a distance between the first and the second apparatus may comprise determining from one of the first or second apparatus a distance to the other of the second or first apparatus respectively.

Generating a level control for mixing the at least one first audio signal and the at least one second audio signal based on the distance between the first and the second apparatus may comprise generating a level control for mixing the at least one first audio signal and the at least one second audio signal such that the combined volume of the at least one first audio signal and the at least one second signal is substantially constant from a first distance between the first apparatus and the second apparatus and a second distance between the first apparatus and the second apparatus, wherein the first distance is smaller than the second distance.

Generating a level control for mixing the at least one first audio signal and the at least one second audio signal based on the distance between the first and the second apparatus may comprise generating a level control for mixing the at least one first audio signal and the at least one second audio signal such that one of the at least one first audio signal and the at least one second audio signal is muted where the distance between the first apparatus and the second apparatus is less than a determined threshold distance.

Generating a level control for mixing the at least one first audio signal and the at least one second audio signal based on the distance between the first and the second apparatus may comprise generating a level control for mixing the at least one first audio signal and the at least one second audio signal such that one of the at least one first audio signal and the at least one second audio signal is the significant component where the distance between the first apparatus and the second apparatus is greater than a determined threshold distance.

Receiving at least one first audio signal from a first apparatus may comprise receiving at least one first audio signal from a proximate microphone and receiving at least one second audio signal from a second apparatus may comprise receiving the at least one second audio signal from a remote apparatus.

According to a second aspect there is provided an apparatus comprising: means for receiving at least one first audio signal from a first apparatus; means for receiving at least one second audio signal from a second apparatus; means for determining a distance between the first and the second apparatus; and means for generating a level control for mixing the at least one first audio signal and the at least one second audio signal based on the distance between the first and the second apparatus.

The apparatus may further comprise means for mixing the at least one first audio signal and the at least one second audio signal based on the level control.

The apparatus may further comprise means for determining a correlation between the at least one first audio signal and the at least one second audio signal.

The apparatus may further comprise means for synchronising one of the at least one first or at least one second audio signal to the other of the at least one second or at least one first audio signal respectively based on the correlation between the at least one first audio signal and the at least one second audio signal.

The means for generating a level control for mixing the at least one first audio signal and the at least one second audio signal based on the distance between the first and the second apparatus may be further based on the correlation between the first audio signal and the at least one second signal.

The apparatus may further comprise means for determining a signal to noise ratio of the at least one first audio signal, wherein the means for generating a level control for mixing the at least one first audio signal and the at least one second audio signal based on the distance between the first and the second apparatus may be further based on the signal to noise ratio of the at least one first audio signal.

The apparatus may further comprise means for determining a signal to noise ratio of the at least one second audio signal, wherein the means for generating a level control for mixing the at least one first audio signal and the at least one second audio signal based on the distance between the first and the second apparatus is further based on the signal to noise ratio of the at least one second audio signal.

The apparatus may further comprise means for determining at least one user input, wherein the means for generating a level control for mixing the at least one first audio signal and the at least one second audio signal based on the distance between the first and the second apparatus may be further based on the at least one user input.

The means for determining a distance between the first and the second apparatus may comprise: means for determining a location estimation of the first apparatus; means for determining a location estimation of the second apparatus; means for determining a distance based on a location difference between the location estimation of the first apparatus and the location estimation of the second apparatus.

The means for determining a distance between the first and the second apparatus may comprise means for determining from one of the first or second apparatus a distance to the other of the second or first apparatus respectively.

The means for generating a level control for mixing the at least one first audio signal and the at least one second audio signal based on the distance between the first and the second apparatus may comprise means for generating a level control for mixing the at least one first audio signal and the at least one second audio signal such that the combined volume of the at least one first audio signal and the at least one second signal is substantially constant from a first distance between the first apparatus and the second apparatus and a second distance between the first apparatus and the second apparatus, wherein the first distance may be smaller than the second distance.

The means for generating a level control for mixing the at least one first audio signal and the at least one second audio signal based on the distance between the first and the second apparatus may comprise means for generating a level control for mixing the at least one first audio signal and the at least one second audio signal such that one of the at least one first audio signal and the at least one second audio signal is muted where the distance between the first apparatus and the second apparatus is less than a determined threshold distance.

The means for generating a level control for mixing the at least one first audio signal and the at least one second audio signal based on the distance between the first and the second apparatus may comprise means for generating a level control for mixing the at least one first audio signal and the at least one second audio signal such that one of the at least one first audio signal and the at least one second audio signal is the significant component where the distance between the first apparatus and the second apparatus is greater than a determined threshold distance.

The means for receiving at least one first audio signal from a first apparatus may comprise means for receiving at least one first audio signal from a proximate microphone and means for receiving at least one second audio signal from a second apparatus may comprise means for receiving the at least one second audio signal from a remote apparatus.

According to a third aspect there is provided an apparatus comprising at least one processor and at least one memory including computer code for one or more programs, the at least one memory and the computer code configured to with the at least one processor cause the apparatus to at least: receive at least one first audio signal from a first apparatus; receive at least one second audio signal from a second apparatus; determine a distance between the first and the second apparatus; and generate a level control for mixing the at least one first audio signal and the at least one second audio signal based on the distance between the first and the second apparatus.

The apparatus may further be caused to mix the at least one first audio signal and the at least one second audio signal based on the level control.

The apparatus may further be caused to determine a correlation between the at least one first audio signal and the at least one second audio signal.

The apparatus may further be caused to synchronise one of the at least one first or at least one second audio signal to the other of the at least one second or at least one first audio signal respectively based on the correlation between the at least one first audio signal and the at least one second audio signal.

Generating a level control for mixing the at least one first audio signal and the at least one second audio signal based on the distance between the first and the second apparatus may be further based on the correlation between the first audio signal and the at least one second signal.

The apparatus may further be caused to determine a signal to noise ratio of the at least one first audio signal, wherein generating a level control for mixing the at least one first audio signal and the at least one second audio signal based on the distance between the first and the second apparatus may be further based on the signal to noise ratio of the at least one first audio signal.

The apparatus may further be caused to determine a signal to noise ratio of the at least one second audio signal, wherein generating a level control for mixing the at least one first audio signal and the at least one second audio signal based on the distance between the first and the second apparatus is further based on the signal to noise ratio of the at least one second audio signal.

The apparatus may further be caused to determine at least one user input, wherein the generating a level control for mixing the at least one first audio signal and the at least one second audio signal based on the distance between the first and the second apparatus may be further based on the at least one user input.

Determining a distance between the first and the second apparatus may cause the apparatus to: determine a location estimation of the first apparatus; determine a location estimation of the second apparatus; determine a distance based on a location difference between the location estimation of the first apparatus and the location estimation of the second apparatus.

Determining a distance between the first and the second apparatus may cause the apparatus to determine from one of the first or second apparatus a distance to the other of the second or first apparatus respectively.

Generating a level control for mixing the at least one first audio signal and the at least one second audio signal based on the distance between the first and the second apparatus may cause the apparatus to generate a level control for mixing the at least one first audio signal and the at least one second audio signal such that the combined volume of the at least one first audio signal and the at least one second signal is substantially constant from a first distance between the first apparatus and the second apparatus and a second distance between the first apparatus and the second apparatus, wherein the first distance may be smaller than the second distance.

Generating a level control for mixing the at least one first audio signal and the at least one second audio signal based on the distance between the first and the second apparatus may cause the apparatus to generate a level control for mixing the at least one first audio signal and the at least one second audio signal such that one of the at least one first audio signal and the at least one second audio signal is muted where the distance between the first apparatus and the second apparatus is less than a determined threshold distance.

Generating a level control for mixing the at least one first audio signal and the at least one second audio signal based on the distance between the first and the second apparatus may cause the apparatus to generate a level control for mixing the at least one first audio signal and the at least one second audio signal such that one of the at least one first audio signal and the at least one second audio signal is the significant component where the distance between the first apparatus and the second apparatus is greater than a determined threshold distance.

Receiving at least one first audio signal from a first apparatus may cause the apparatus to receive at least one first audio signal from a proximate microphone and receiving at least one second audio signal from a second apparatus may cause the apparatus to receive the at least one second audio signal from a remote apparatus.

According to a fourth aspect there is provided an apparatus comprising: an input configured to receive at least one first audio signal from a first apparatus; an input configured to receive at least one second audio signal from a second apparatus; a distance detector configured to determine a distance between the first and the second apparatus; and a level control generator configured to generate a level control for mixing the at least one first audio signal and the at least one second audio signal based on the distance between the first and the second apparatus.

The apparatus may further comprise a mixer configured to mix the at least one first audio signal and the at least one second audio signal based on the level control.

The apparatus may further comprise an audio processor configured to determine a correlation between the at least one first audio signal and the at least one second audio signal.

The apparatus may further comprise a synchronisation buffer configured to synchronise one of the at least one first or at least one second audio signal to the other of the at least one second or at least one first audio signal respectively based on the correlation between the at least one first audio signal and the at least one second audio signal.

The mixer may be further configured to mix the at least one first audio signal and the at least one second audio signal based on the correlation between the first audio signal and the at least one second signal.

The apparatus may further comprise a first signal to noise estimator configured to determine a signal to noise ratio of the at least one first audio signal, wherein the level control determiner may be configured to generate a level control for mixing the at least one first audio signal and the at least one second audio signal further based on the signal to noise ratio of the at least one first audio signal.

The apparatus may further comprise a second signal to noise estimator configured to determine a signal to noise ratio of the at least one second audio signal, wherein the level control determiner may be configured to generate a level control for mixing the at least one first audio signal and the at least one second audio signal further based on the signal to noise ratio of the at least one second audio signal.

The apparatus may further comprise a further input configured to determine at least one user input, wherein the level control determiner may be configured to generate a level control for mixing the at least one first audio signal and the at least one second audio signal further based on the at least one user input.

The distance detector may be configured to: determine a location estimation of the first apparatus; determine a location estimation of the second apparatus; determine a distance based on a location difference between the location estimation of the first apparatus and the location estimation of the second apparatus.

The distance detector may be configured to determine from one of the first or second apparatus a distance to the other of the second or first apparatus respectively.

The level control determiner may be configured to generate a level control for mixing the at least one first audio signal and the at least one second audio signal such that the combined volume of the at least one first audio signal and the at least one second signal is substantially constant from a first distance between the first apparatus and the second apparatus and a second distance between the first apparatus and the second apparatus, wherein the first distance may be smaller than the second distance.

The level control determiner may be configured to generate a level control for mixing the at least one first audio signal and the at least one second audio signal such that one of the at least one first audio signal and the at least one second audio signal is muted where the distance between the first apparatus and the second apparatus is less than a determined threshold distance.

The level control determiner may be configured to generate a level control for mixing the at least one first audio signal and the at least one second audio signal such that one of the at least one first audio signal and the at least one second audio signal is the significant component where the distance between the first apparatus and the second apparatus is greater than a determined threshold distance.

The input configured to receiving at least one first audio signal from a first apparatus may be configured to receive at least one first audio signal from a proximate microphone and the input configured to receive at least one second audio signal from a second apparatus may be configured to receive the at least one second audio signal from a remote apparatus.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For better understanding of the present application, reference will now be made by way of example to the accompanying drawings in which.

EMBODIMENTS

Figure 1:
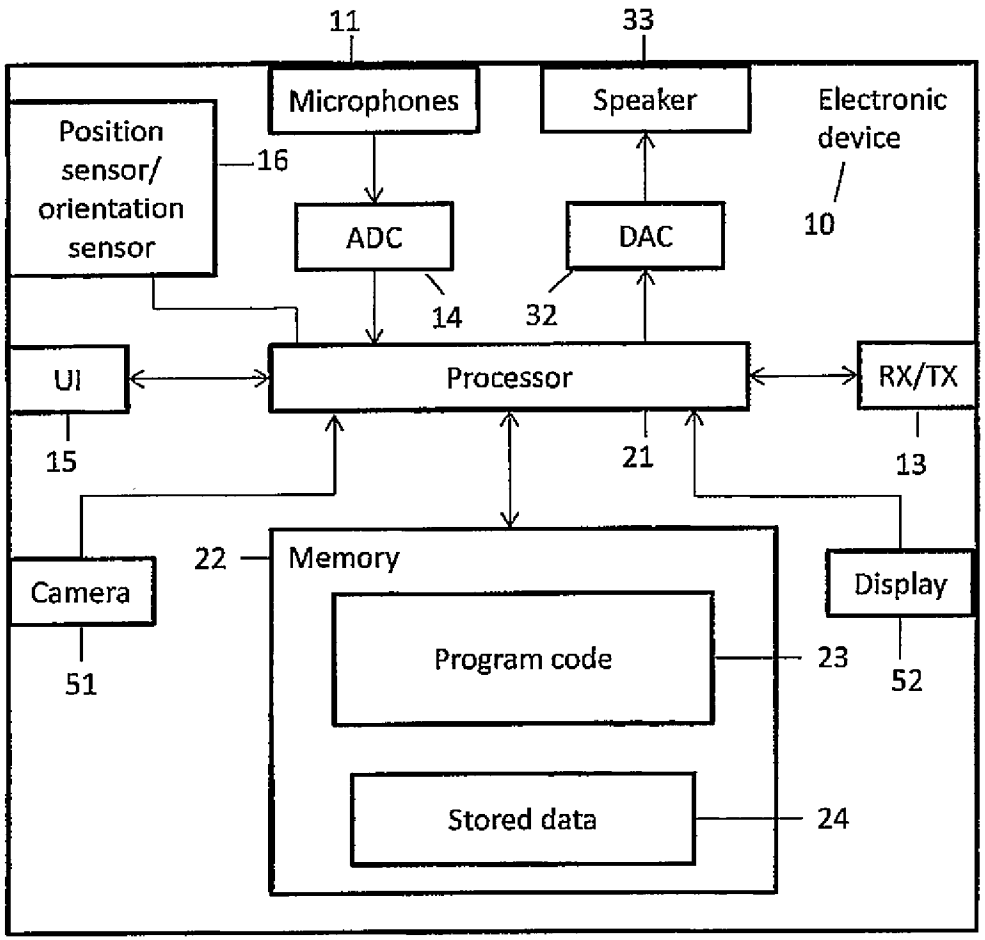
FIG. 1 shows schematically an apparatus suitable for being employed in some embodiments.

The following describes in further detail suitable apparatus and possible mechanisms for the provision of effective management of remote audio sources on a host apparatus for example with respect mixing of audio recordings from remote microphone equipped apparatus within audio-video capture apparatus. In the following examples for simplicity audio signal processing is described separate from any video processing. However it would be appreciated that in some embodiments the audio signal processing is a part of an audio-video system.

As described herein mobile devices or apparatus are more commonly being equipped with microphone configurations or microphone arrays suitable for recording or capturing the audio environment or audio scene surrounding the mobile device or apparatus. These microphone configurations can enable recording of stereo or surround sound signals. Furthermore mobile devices or apparatus are equipped with suitable transmitting and receiving means to permit a single host device or apparatus to be surrounded, by a rich environment of recording devices. The host or master devices can receive the recording or remote device audio signals and in some circumstances mix them with the host device audio signals to generate better quality audio output.

Normally the remote mobile devices (or remote microphones) audio signal(s) when mixed with the host or master main spatial audio signal are mixed as a monophonic signal panned to the centre of the host or master device audio scene. Furthermore when the audio source is near the host device, the audio source is largely captured by host device microphone(s) and the remote device microphone(s) whilst when the audio source is far from the host device the audio source is captured mainly by the remote device microphone (s). To manage this manual mixing is typically performed. Manual control of mixing level of remote device microphone(s) for distributed capture is a difficult task to perform alone and more difficult still when the user of the host or master device is attempting some other task, for example capturing video on the host device. Constant mixing or level mixing where the host and remote device inputs are mixed with the same gain will produce sub-optimal results and can result in mixing levels which are too low when the audio source is remote from the host device and mixing levels too high when the audio source is too close to the host device.

In the embodiments as described herein within a multi-device audio capture environment, a host device can be configured to capture host or master or main audio signal(s) while one or multiple other 'remote' devices in the same acoustic space also capture or record audio as well (in other words working as wireless remote microphones) and stream their signals to the host device in real time or at a later time and stored for combining recordings.

The concept of the embodiments described herein is to generate a mixing control which compensates or allows for the distances between the main source and the host and the remote devices.

In this regard reference is first made to FIG. 1 which shows a schematic block diagram of an exemplary apparatus or electronic device 10, which may be used as for example as a host or a remote device.

The electronic device 10 may for example be a mobile terminal or user equipment of a wireless communication system when functioning as the recording apparatus or listening apparatus. In some embodiments the apparatus can be an audio player or audio recorder, such as an MP3 player, a media recorder/player (also known as an MP4 player), or any suitable portable apparatus suitable for recording audio or audio/video camcorder/memory audio or video recorder.

The apparatus 10 can in some embodiments comprise an audio-video subsystem. The audio-video subsystem for example can comprise in some embodiments a microphone or array of microphones 11 for audio signal capture. In some embodiments the microphone or array of microphones can be a solid state microphone, in other words capable of capturing audio signals and outputting a suitable digital format signal. In some other embodiments the microphone or array of microphones 11 can comprise any suitable microphone or audio capture means, for example a condenser microphone, capacitor microphone, electrostatic microphone, electret condenser microphone, dynamic microphone, ribbon microphone, carbon microphone, piezoelectric microphone, or micro electrical-mechanical system (MEMS) microphone. In some embodiments the microphone 11 is a digital microphone array, in other words configured to generate a digital signal output (and thus not requiring an analogue-to-digital converter). The microphone 11 or array of microphones can in some embodiments output the audio captured signal to an analogue-to-digital converter (ADC) 14.

In some embodiments the apparatus can further comprise an analogue-to-digital converter (ADC) 14 configured to receive the analogue captured audio signal from the microphones and outputting the audio captured signal in a suitable digital form. The analogue-to-digital converter 14 can be any suitable analogue-to-digital conversion or processing means. In some embodiments the microphones are 'integrated' microphones containing both audio signal generating and analogue-to-digital conversion capability.

In some embodiments the apparatus 10 audio-video subsystem further comprises a digital-to-analogue converter 32 for converting digital audio signals from a processor 21 to a suitable analogue format. The digital-to-analogue converter (DAC) or signal processing means 32 can in some embodiments be any suitable DAC technology.

Furthermore the audio-video subsystem can comprise in some embodiments a speaker 33. The speaker 33 can in some embodiments receive the output from the digital-to-analogue converter 32 and present the analogue audio signal to the user. In some embodiments the speaker 33 can be representative of multi-speaker arrangement, a headset, for example a set of headphones, or cordless headphones.

In some embodiments the apparatus audio-video subsystem comprises a camera 51 or image capturing means configured to supply to the processor 21 image data. In some embodiments the camera can be configured to supply multiple images over time to provide a video stream.

In some embodiments the apparatus audio-video subsystem comprises a display 52. The display or image display means can be configured to output visual images which can be viewed by the user of the apparatus. In some embodiments the display can be a touch screen display suitable for supplying input data to the apparatus. The display can be any suitable display technology, for example the display can be implemented by a flat panel comprising cells of LCD, LED, OLED, or 'plasma' display implementations.

Although the apparatus 10 is shown having both audio/video capture and audio/video presentation components, it would be understood that in some embodiments the apparatus 10 can comprise one or the other of the audio capture and audio presentation parts of the audio subsystem such that in some embodiments of the apparatus the microphone (for audio capture) or the speaker (for audio presentation) are present. Similarly in some embodiments the apparatus 10 can comprise one or the other of the video capture and video presentation parts of the video subsystem such that in some embodiments the camera 51 (for video capture) or the display 52 (for video presentation) is present.

Furthermore although in the following examples it is described that the microphone(s) are part of the apparatus it would be understood that in some embodiments the microphone or microphone array is physically separate from the apparatus. For example the microphone(s) can be located on a headset or hearing aid (where optionally the headset can have an associated video camera or other suitable sensor) which wirelessly or otherwise passes the audio signals and other sensor information to the apparatus for processing.

In some embodiments the apparatus 10 comprises a processor 21. The processor 21 is coupled to the audio-video subsystem and specifically in some examples the analogue-to-digital converter 14 for receiving digital signals representing audio signals from the microphone 11, the digital-to-analogue converter (DAC) 12 configured to output processed digital audio signals, the camera 51 for receiving digital signals representing video signals, and the display 52 configured to output processed digital video signals from the processor 21.

The processor 21 can be configured to execute various program codes. The implemented program codes can comprise for example audio (or audio-video) recording and audio (or audio-video) presentation routines. In some embodiments the program codes can be configured to perform audio signal receiving, processing or mapping or spatial audio signal processing.

In some embodiments the apparatus further comprises a memory 22. In some embodiments the processor is coupled to memory 22. The memory can be any suitable storage means. In some embodiments the memory 22 comprises a program code section 23 for storing program codes implementable upon the processor 21. Furthermore in some embodiments the memory 22 can further comprise a stored data section 24 for storing data, for example data that has been encoded in accordance with the application or data to be encoded via the application embodiments as described later. The implemented program code stored within the program code section 23, and the data stored within the stored data section 24 can be retrieved by the processor 21 whenever needed via the memory-processor coupling.

In some further embodiments the apparatus 10 can comprise a user interface 15. The user interface 15 can be coupled in some embodiments to the processor 21. In some embodiments the processor can control the operation of the user interface and receive inputs from the user interface 15. In some embodiments the user interface 15 can enable a user to input commands to the electronic device or apparatus 10, for example via a keypad, and/or to obtain information from the apparatus 10, for example via a display which is part of the user interface 15. The user interface 15 can in some embodiments as described herein comprise a touch screen or touch interface capable of both enabling information to be entered to the apparatus 10 and further displaying information to the user of the apparatus 10.

In some embodiments the apparatus further comprises a transceiver 13, the transceiver in such embodiments can be coupled to the processor and configured to enable a communication with other apparatus or electronic devices, for example via a wireless communications network. The transceiver 13 or any suitable transceiver or transmitter and/or receiver means can in some embodiments be configured to communicate with other electronic devices or apparatus via a wire or wired coupling.

The transceiver 13 can communicate with further apparatus by any suitable known communications protocol, for example in some embodiments the transceiver 13 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the apparatus comprises a position sensor 16 configured to estimate the position of the apparatus 10. The position sensor 16 can in some embodiments be a satellite positioning sensor such as a GPS (Global Positioning System), GLONASS or Galileo receiver.

In some embodiments the positioning sensor can be a cellular ID system or an assisted GPS system.

In some embodiments the apparatus 10 further comprises a direction or orientation sensor. The orientation/direction sensor can in some embodiments be an electronic compass, accelerometer, and a gyroscope or be determined by the motion of the apparatus using the positioning estimate.

It is to be understood again that the structure of the electronic device 10 could be supplemented and varied in many ways.

Figure 2:
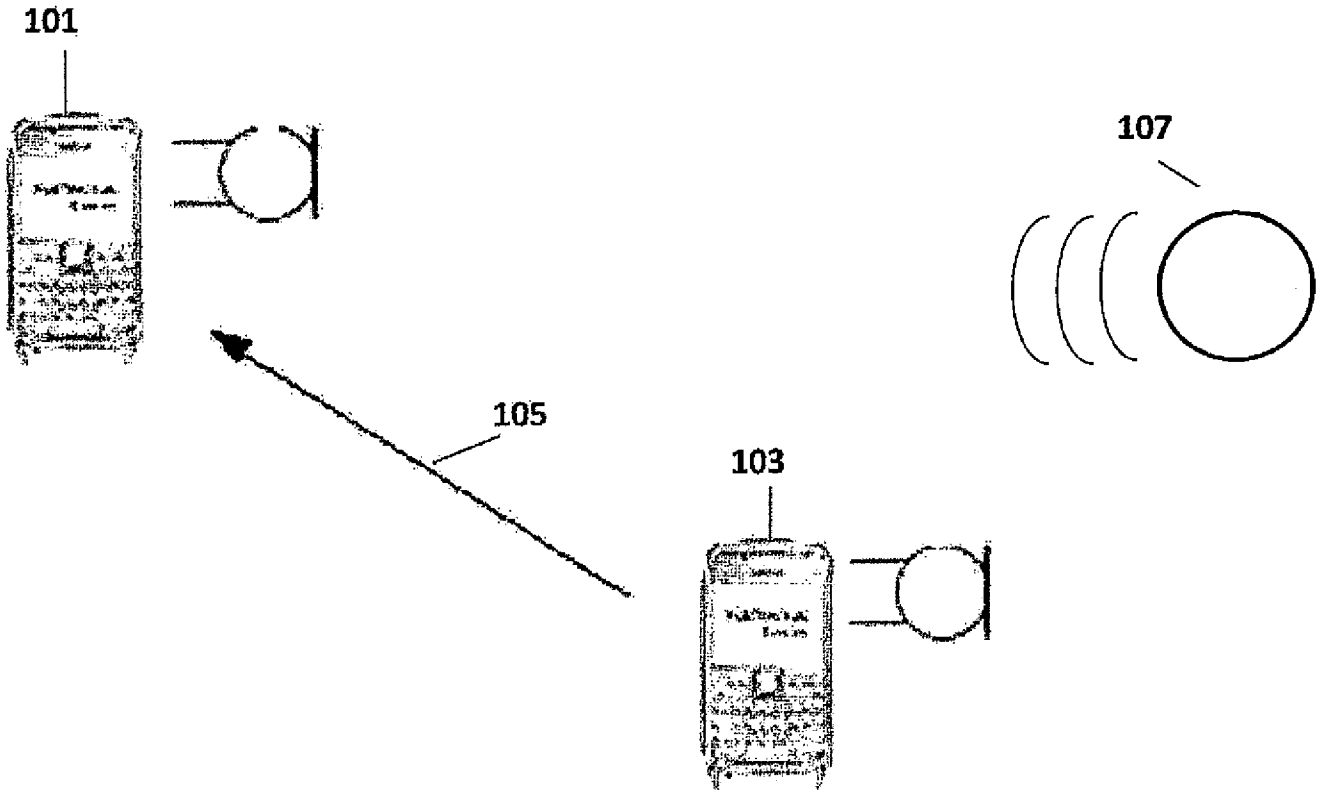
FIG. 2 shows schematically a multi-device system suitable for implementing embodiments as described herein.

With respect to FIG. 2 an example multi-device system suitable for implementing embodiments as described herein is shown.

FIG. 2 shows for example an audio environment, such as the audio scene with an audio source 107 and where a host or master device (or apparatus) 101 can be configured to communicate with a first remote device (or apparatus) 103 by a first communication link 105. As shown in FIG. 2 the remote device 103 can be located around the host or master device 101.

Figure 3:
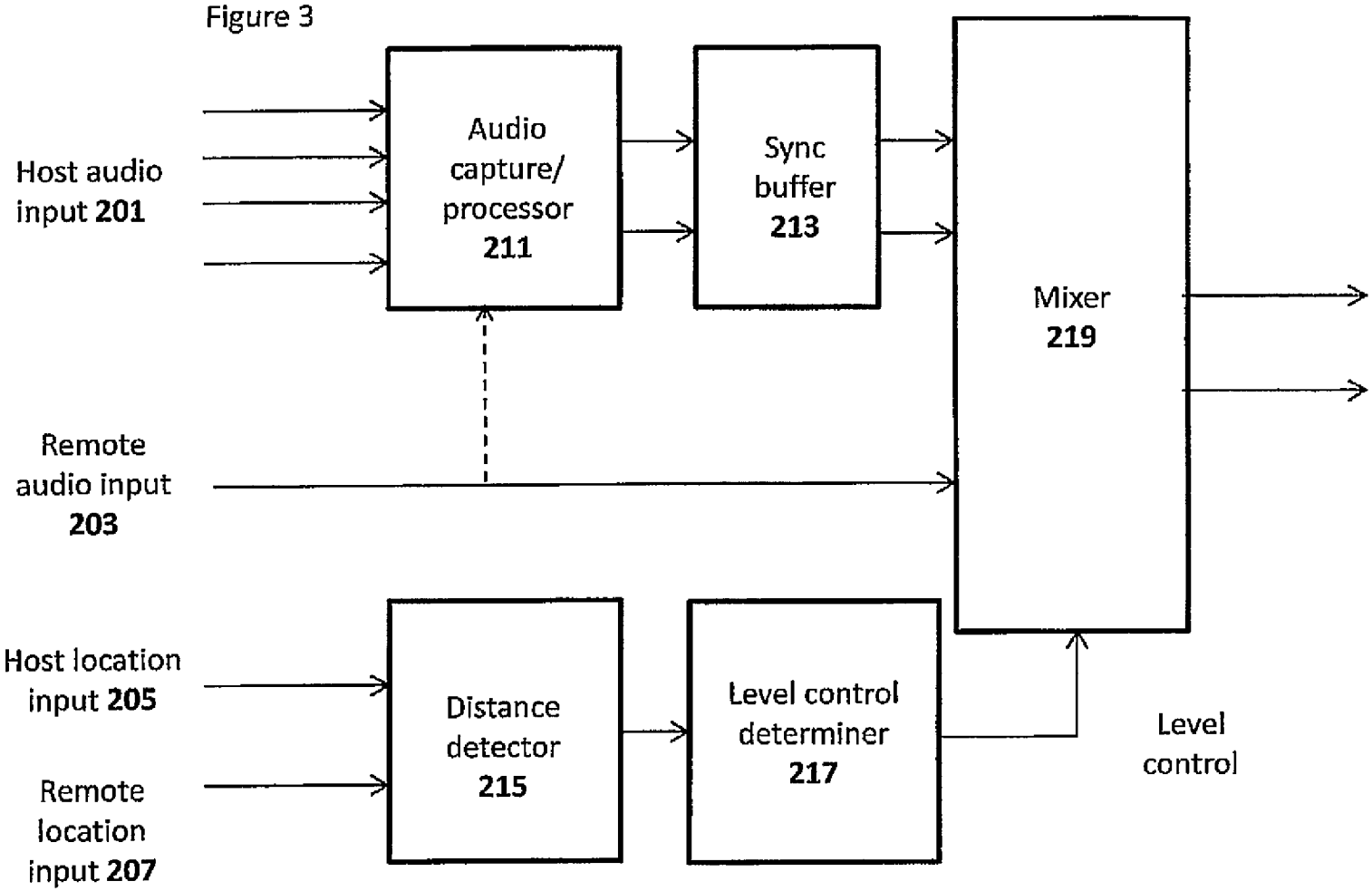
FIG. 3 shows schematically an example host apparatus according to some embodiments.

With respect to FIG. 3 an example host device (or apparatus) according to some embodiments is shown in further detail. Furthermore with respect to FIG. 4 a flow diagram showing the operation of the host device as shown in FIG. 3 is described with respect to some embodiments. In the following examples the apparatus and methods describe the activity of the host device with respect to a single remote device. It would be understood that in some embodiments the host can receive, determine and process (for example spatially process and mix with the host device audio signals) more than one remote device at a time. In other words the host device or apparatus can be configured to receive audio signals from at least one further apparatus or remote device. It would be further understood that in some embodiments at least one of the at least one further apparatus may output to the apparatus or host device more than one audio signal.

In the following examples audio signals used in audio/visual recording are described, however it would be understood that the same principles as described herein can be used in pure audio signal recording or capturing.

In some embodiments the host device (or apparatus) comprises a location (or position) determiner or suitable means for determining the location of the host device or apparatus. In such embodiments the location or position can be passed on a host location input 205 to a distance detector 215.

Figure 4:
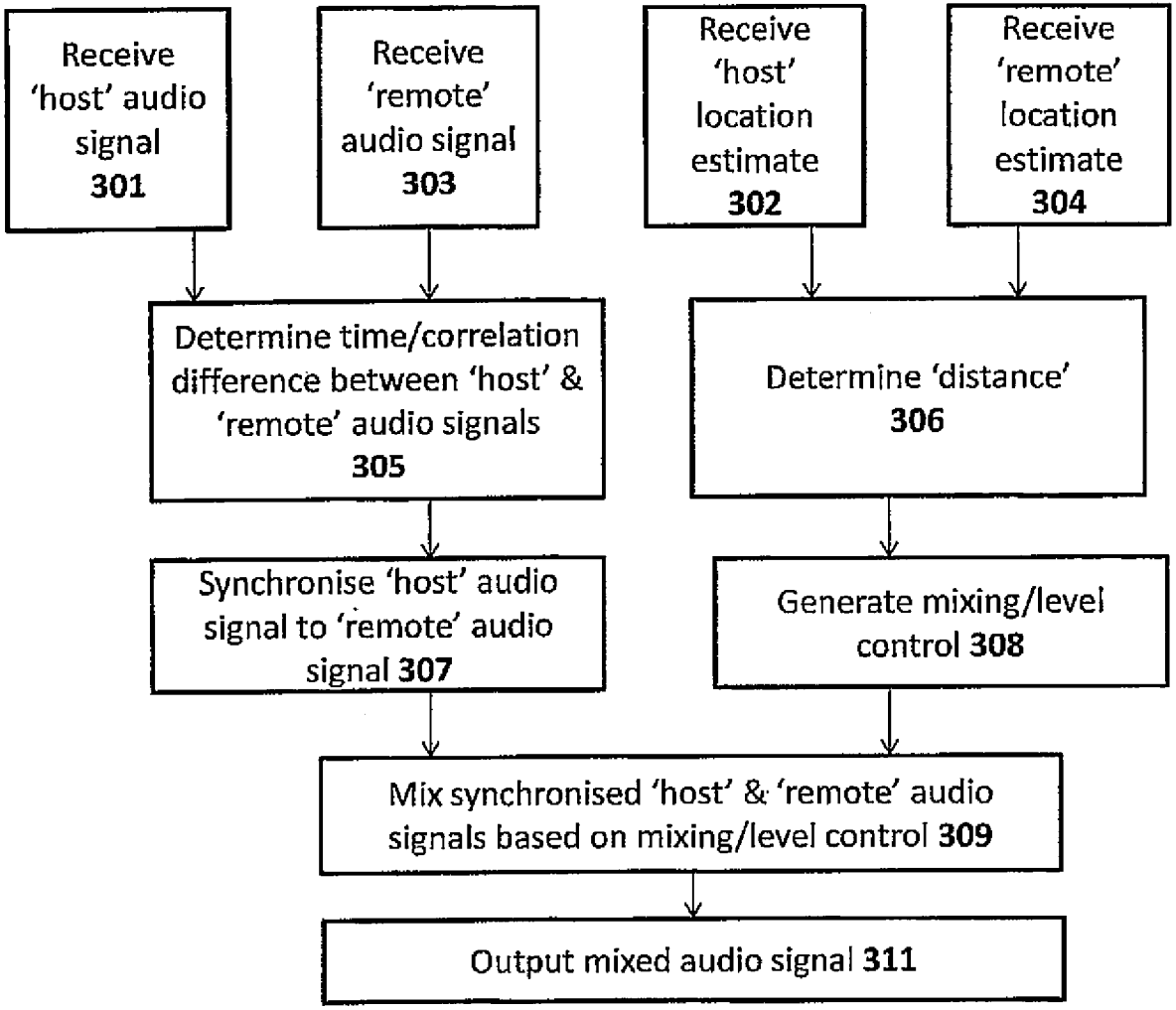
FIG. 4 shows schematically a flow diagram of the operation of the host apparatus shown in FIG. 3 employing distance based mixing control according to some embodiments.

The operation of receiving a host location (or orientation) is shown in FIG. 4 by step 302.

The host location or position determiner or suitable means for determining the host device location (or position) can in some embodiments comprise a position or location estimator (or suitable means for determining a host device position or location), for example a satellite positioning receiver (such as a GPS receiver) and thus can be configured to generate a positional estimate of the host device. It would be understood that the position or location estimator can in some embodiments be configured to use any suitable location estimation method, for example radio or ultrasound beacon location determination or inertial location estimation. In some embodiments the position or location determiner can be configured to determine the location or position of the apparatus by performing an active location estimation operations such as indoor positioning radio frequency location estimation where the environment surrounding the apparatus is mapped for example using LIDAR (Light Detection and Ranging), LADAR (Laser Imaging Detection and Ranging), or ultrasound location estimation or infrared location estimation.

In some embodiments the host position or location estimate is generated based on images from a camera, such as the device camera.

In some embodiments the host device (or apparatus) comprises an input configured to receive information on the location (or position) of the remote device or apparatus. In some embodiments this input is configured to receive the information via a transceiver. In some embodiments the information can be passed to the host device as a signal comprising the location or position of the remote device and the at least one audio signal from the remote device. For example in some embodiments the host device or apparatus is configured to receive a meta-file comprising the at least one audio signal and information on the position or location of the remote device. It would be understood that in some embodiments the remote device itself comprises a location determiner similar to the host location or position determiner or suitable means for determining the remote device location (or position). The remote device having determined the remote device or apparatus position or location estimator (or suitable means for determining a host device position or location) is configured to transmit this information to the host device. In some embodiments this information is combined or mixed with the audio signal also transmitted to the host device or apparatus.

The operation of receiving a remote location (or orientation) is shown in FIG. 4 by step 304.

In the following examples the distance detector 215 is configured to receive the host location input 205 and the remote location input 207 and determine a relative distance between the host location and the remote location values.

In some embodiments the distance value determined is the scalar distance between the host location value $(x_h, y_h)$ and the remote location value $(x_r, y_r)$. For example in some embodiments the distance detector 215 is configured to calculate, $$\text{Dist}=\text{sqrt}((x_h-x_r)^2+(y_h-y_r)^2).$$

The operation of determining the distance is shown in FIG. 4 by step 306.

The distance detector 215 can in some embodiments be configured to output the distance determination to a level control determiner 217.

In some embodiments the distance detector 215 can be implemented by a relative position determiner or suitable means for determining a host device to remote device location difference. In some embodiments the relative host device to remote device location difference determiner can be configured to determine or measure the distance from the host location to the remote location directly. For example, the relative host to remote location difference determiner can use a sensor, such as indoor positioning radio frequency location estimation where the environment surrounding the apparatus is mapped for example using LIDAR (Light Detection and Ranging), LADAR (Laser Imaging Detection and Ranging), ultrasound location estimation or infrared location estimation.

In some embodiments the host device or apparatus comprises a level control determiner 217. The level control determiner 217 can in some embodiments be configured to receive the output of the distance detector 215. The level control determiner 217 is configured to generate a level control signal for controlling the mixing level between a host audio input and a remote audio input. The level control signal can for example be a control output value controlling a gain or attenuation level which is applied to at least one of the host audio signal and the remote audio signal before combining the at least two audio signals. In some embodiments the level control determiner 217 is configured to generate a level control output for each of the input audio signals based on the distance value.

Figure 8:
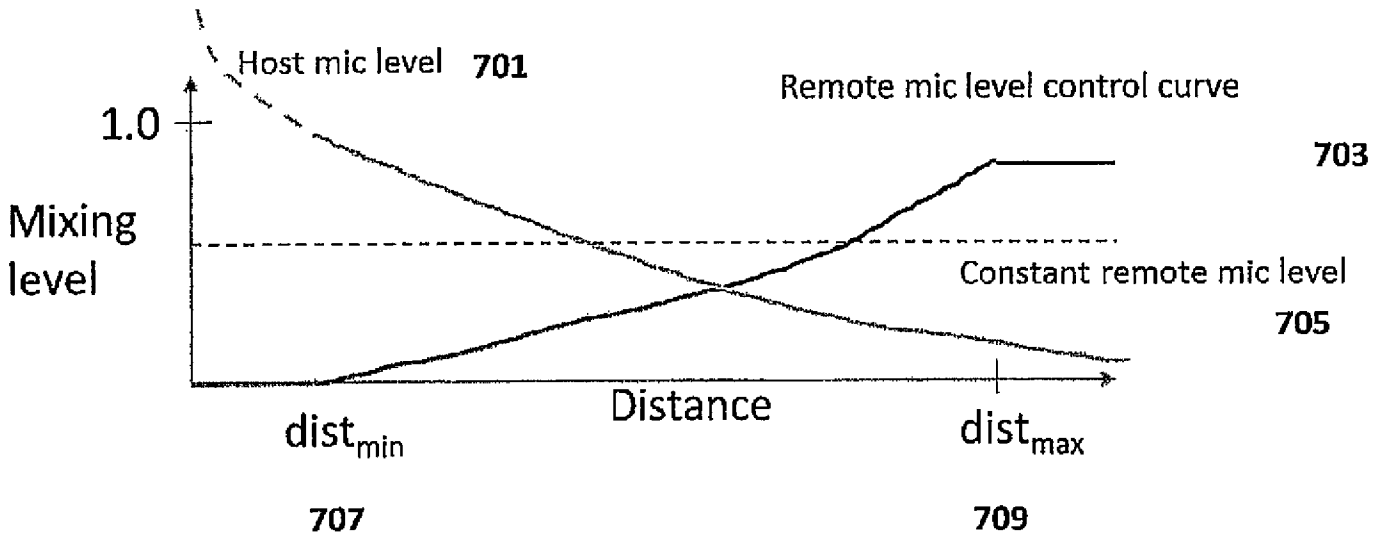
FIG. 8 shows schematically an example distance based mixing control level for a remote device according to some embodiments.

With respect to FIG. 8 an example audio signal level captured by host (microphone) 701 and a control curve to apply to the remote (microphone) audio signal level 703 against distance. In other words the figure shows an example remote device control curve 703. The target in this example is a level control output profile configured such that between a smaller or minimum distance ($dist_{min}$) and a larger or maximum distance ($dist_{max}$) the loudness of the sound source is constant after remote and host signals have been combined, providing that distance from sound source to remote microphone is kept constant. Since the distance between remote microphone and the sound source is kept constant in this example, the distance from the host device or microphone to the remote device or microphone is changed also when the distance from the host device or microphone to sound source changes. As a result, the signal captured by the host microphone changes when the distance to the source changes, which results in a curve such as shown in FIG. 8 by the curve 701. This example curve would be valid for a sound source that emits a stationary signal and where distance from the sound source to the remote microphone is comparable to $dist_{min}$.

In other words, FIG. 8 shows the level of sound source captured by host microphone curve 701, and a level control curve for the remote microphone used in mixing 703. In such an example as shown in FIG. 8 the signal level captured by the remote microphone is kept constant at 705, since the distance between sound source and remote microphone is constant.

As can be shown by FIG. 8 in some embodiments the level control determiner 217 is configured to generate a host (microphone) audio signal level output and the remote (microphone) audio signal level output between 1 and 0 based on the distance such that at and below a minimum distance 707 $dist_{min}$ the mixer is configured to mix the host audio signal input and remote audio signal input such that the host audio signal is 100% of the output and the remote audio signal is 0%. Furthermore as the distance increases from the minimum distance 707 $dist_{min}$ to the maximum distance 709 $dist_{max}$ then in some embodiments the level control output is configured to increase the remote device audio signal contribution by increasing the remote audio signal level output value up to where the distance reaches a maximum distance 709 $dist_{max}$ where the remote audio signal level output value is 1.

In the example shown in FIG. 8 the profile of the remote level control signal 703 (control curves) is a non-linear profile with respect to distance however it would be understood that in some embodiments the level control signal (control curves) have a linear profile or any suitable profile. Furthermore although the example as shown herein is an output profile in the region between 1 and 0 any other suitable output profile can be used. For example in some embodiments the output profile is log scale profile. Furthermore in the described herein the mixing aim was to produce a constant volume level between the minimum and maximum distances but it would be appreciated that any other suitable control curve or aim can be controlled for.

In such embodiments the example host and remote audio signal level output value can be controlled such that where the remote device is near to the host device a low mixing level or even muting is applied to the remote device audio signal. This is because in such situations the host microphone is already recording or capturing the signals from the audio source. In other words in such examples the host microphone is capturing the signals with good quality. Furthermore when the remote device is far from the host device the high mixing level is used for the remote device audio signal (to capture audio from a source near the remote device) as it is possible that due to the large distance between the host and the sound source near the remote device that the host device cannot record or capture the signal because of distance attenuation or background noise conditions. In other words in such examples the host microphone may not capture the signal well.

The level control determiner output 217 can then be passed to the mixer 219.

The operation of generating a mixing or level control is shown in FIG. 4 by step 308.

In some embodiments the host device (or apparatus) comprises an audio capture processor 211 or suitable means for audio signal capture and/or processing. The audio capture processor 211 can in some embodiments be configured to receive at least one host recorded (or captured) audio signal (or in some embodiments means for recording or capturing an audio signal). For example as described herein the host device or apparatus can comprise a microphone array configured to record or capture multi-channel audio signals. The microphone array audio signals can be passed to the audio capture processor via a host audio input 201. The host audio input 201 is shown in FIG. 3 as a multi-channel audio input, however it would be understood that in some embodiments the audio input 201 can be a mono or stereo audio input. Furthermore it would be understood that in some embodiments the host apparatus audio signal is received or recovered or retrieved from memory (for example in off-line processing).

The operation of generating or receiving the host audio signal is shown in FIG. 4 by step 301.

Furthermore the audio capture processor 211 can be configured to receive from the remote device a suitable audio signal or signals, or means for receiving an audio signal or signals from a remote device. The audio signal(s) from the remote device can be received in some embodiments via the transceiver 13 and be any number of channels, encoding or format. For example in some embodiments the remote device audio signal is a mono audio signal, however it would be appreciated that the remote device audio signal can be a stereo or multichannel audio signal. In the example shown in FIG. 3 the remote device audio signal is received at a remote audio input 203 and is passed directly to the mixer 219 and also to the audio capture processor 211.

The operation of receiving the remote audio signals from the remote device is shown in FIG. 4 by step 303.

In some embodiments the host apparatus comprises an audio capture processor 211.

The audio capture processor 211 can in some embodiments be configured to receive the host device audio signal and the remote device audio signal and determine a time shift or correlation between the two audio signals. It would be understood that in some embodiments the determination of the time shift or the correlation between the two signals can be performed on representations of the audio signals in the time or the frequency domains.

In some embodiments the audio capture processor 211 can be configured to output the time shift or correlation determination to a synchronisation buffer 213.

The operation of determining a time shift or correlation between the host and remote audio signals is shown in FIG. 4 by step 305.

Furthermore in some embodiments the audio capture processor 211 can be configured to perform pre-processing on the host audio signal. The pre-processing can for example be at least one of an up-mixing operation, a down-mixing operation, an equalisation operation, a range limiting operation, a sample conversion, or word length conversion operation or in some embodiments to decode the remote device audio signal from an encoded audio signal format suitable for transmission into an audio format suitable for processing. Thus for example the audio capture processor 211 can be configured to convert the multichannel host audio input to a stereo channel audio signal such as shown in FIG. 3.

In some embodiments the host device or apparatus audio signal is then passed to the synchronisation buffer 213.

In some embodiments the host device comprises a synchronisation buffer 213. The synchronisation buffer 213 is configured in some embodiments to delay or synchronise the host audio signal with the remote audio signal such that the audio signals reaching the mixer are substantially synchronised. In some embodiments the synchronisation buffer 213 is configured to receive a delay input indicating the delay value required to synchronise the two audio signals (the host and the remote device audio signals). For example as shown in FIG. 3 the synchronisation buffer 213 is configured to receive the delay input in the form of the time shift correlation value determined by the audio capture processor 211.

The operation of delaying the host audio signal for synchronising the host to remote audio signals is shown in FIG. 4 by step 307.

In some embodiments the synchronisation buffer 213 is configured to output the synchronised or delayed host audio signals to the mixer 219.

In some embodiments the host apparatus comprises a mixer 219. The mixer 219 can be configured to receive the remote device audio signals such as from the remote audio input 203 and the synchronised (or delayed) host device audio signals such as from the synchronisation buffer 213. The mixer 219 can further configured to receive a level control input such as from the level control determiner 217. The level control input can be used in some embodiments to determine the ratio of mixing between the remote device and host device audio signals. The mixer 219 can in some embodiments then combine the host device and remote device audio signals in the ratio of mixing as determined by the level control input value. In some arrangements, the remote audio input 203 may be buffered before feeding it to the mixer.

Figure 9:
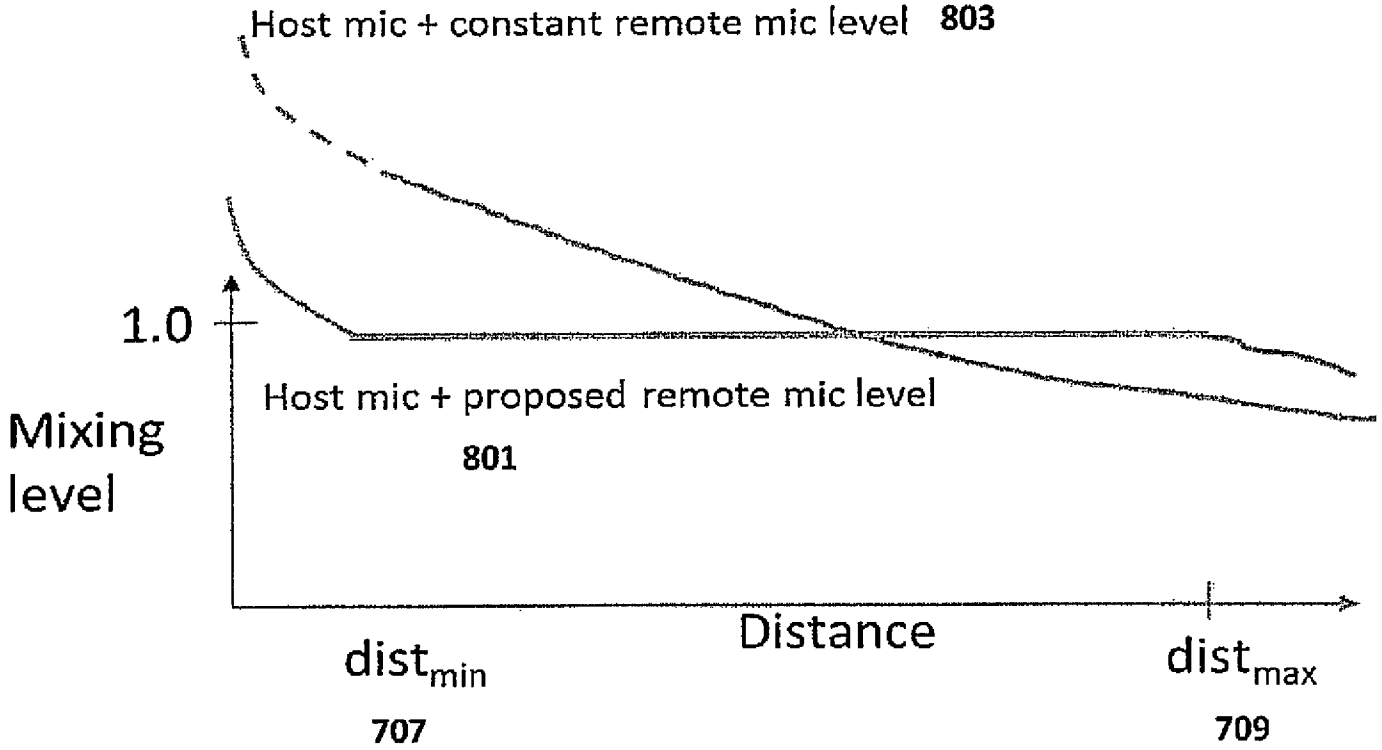
FIG. 9 shows schematically example mixing control levels preventing high volume outputs according to some embodiments.

As is shown in FIG. 9 in some embodiments the mixing of the host audio signal and the remote audio signal is such that the output level 801 is a combination of host (microphone) audio signal level and remote (microphone) audio signal level. The output level 801 according to some embodiments can be contrasted against the output level at a constant level (in other words without a variable level based on the distance profile) where it can be seen that the output level according to some embodiments produces a output level which between the minimum distance 707 $dist_{min}$ and the maximum distance 709 $dist_{max}$ is generated independent of the distance value whereas constant level mixing as shown by the output level 803 produces an output which is too loud at near distances and too quiet when far from the host device. Thus in some embodiments it can be possible to match the source level captured by the host device multiple microphones and the same audio source captured by remote device microphone(s).

The mixing of the remote device and host device audio signals is shown in FIG. 4 by step 309.

The mixer can then output the mixed audio signals to be used, stored or further processed.

The outputting of the mixed audio signals is shown in FIG. 4 by step 311.

Figure 5:
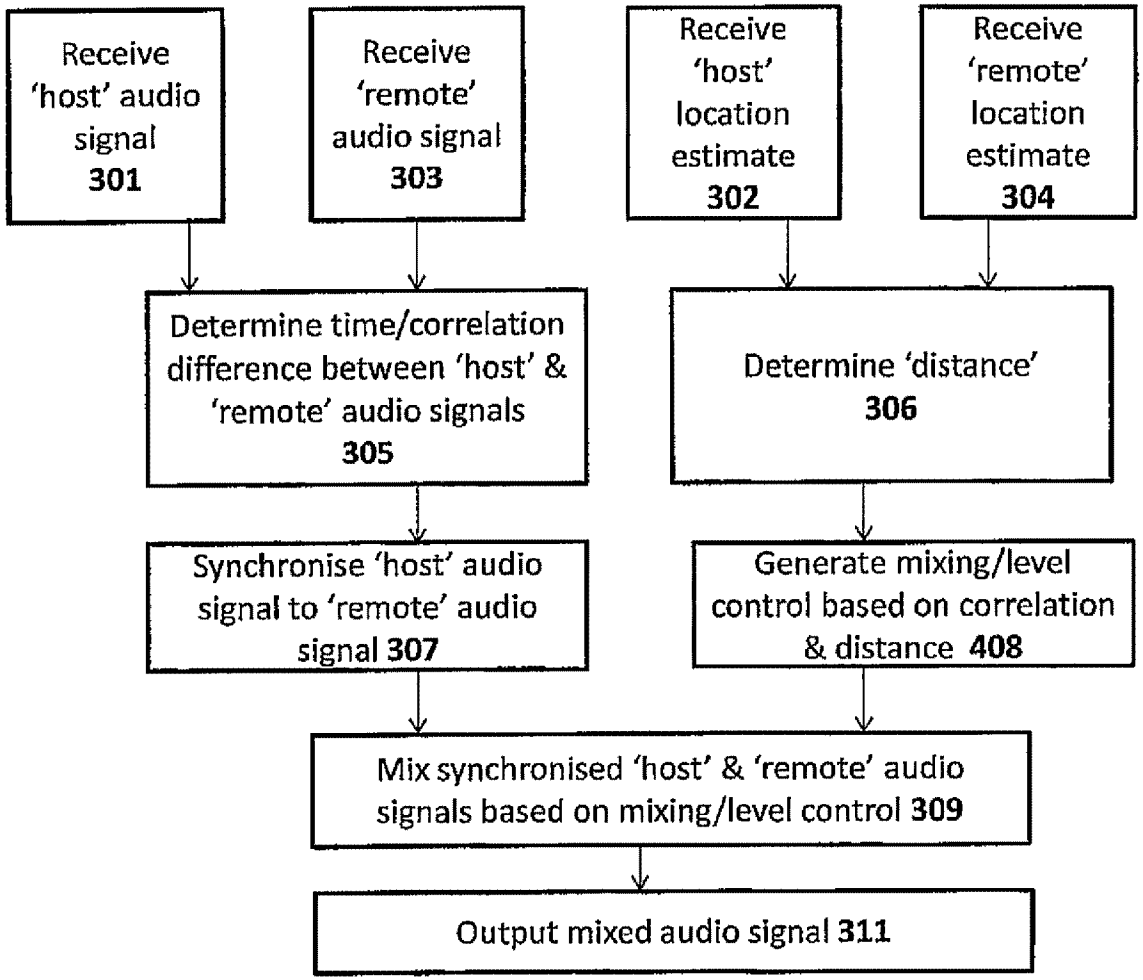
FIG. 5 shows schematically a flow diagram of the operation of the host apparatus shown in FIG. 3 employing distance and correlation based mixing control according to some embodiments.

With respect to FIG. 5 a flow diagram showing the operation of the host device according to some further embodiments is shown. In such embodiments the time shift/correlation between the host and remote device (microphone) audio signals can be used as an auxiliary cue for the level control. In other words the audio capture processor 211 can be configured to pass to the level control determiner 217 information about the correlation between the host and the remote device audio signals.

Thus in such embodiments where a remote device (microphone) audio signal reflects that the remote device has left the room/environment where the host device is located or for example closed a door or other audio blocking element then although the two devices can be near each other the acoustic path has been disconnected. Sometimes this is called common acoustic space detection. In some embodiments the detection of separate acoustic spaces (where they are not common acoustic spaces due to the closed door or other audio blocking element) can cause the level control determiner to be switched off or in other words switch off the distance (level) control input to the mixer or use a different control curve.

Figure 6:
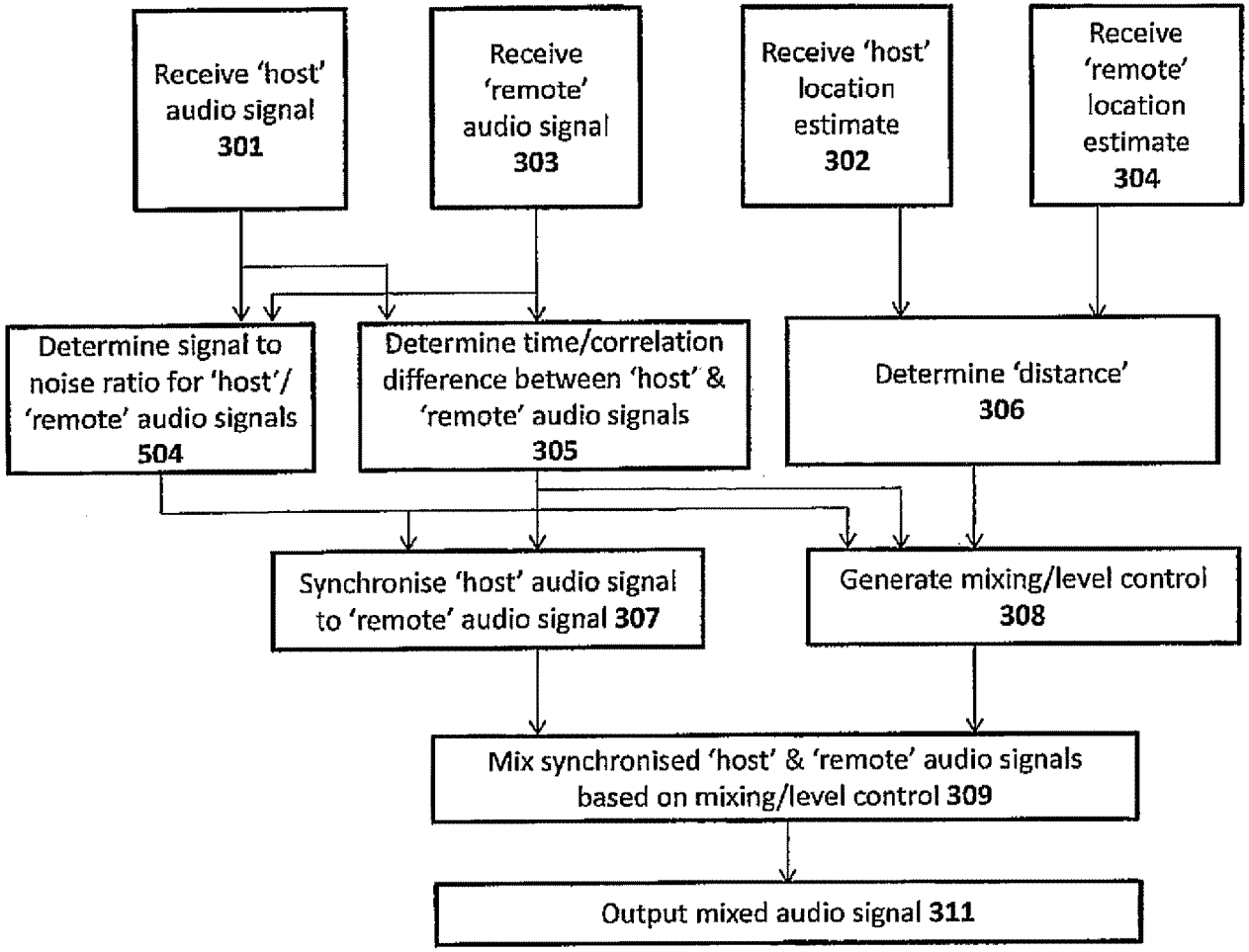
FIG. 6 shows schematically an additional flow diagram of the operation of the host apparatus shown in FIG. 3 employing signal to noise, distance and correlation based mixing control according to some embodiments.

With respect to FIG. 6 a further flow diagram showing the operation of the host device according to some further embodiments is shown. In such embodiments the host device comprises a signal to noise estimator configured to receive at least one of the host device audio signal and the remote device audio signal. The signal to noise estimator can be configured to determine a signal to noise ratio estimate for the host and the remote audio signals or at least one of the host and the remote device audio signals.

The determination of the signal to noise ratio for at least one of the host audio signal and the remote audio signal is shown in FIG. 6 by step 504.

The signal to noise estimator can further output the signal to noise estimation to the level control determiner. The level control determiner can then use the signal-to-noise ratio as an additional factor to control mixing level.

In some embodiments the distance based level control (which targets for constant loudness for remote source) may suggest providing a small mixing level for a remote microphone when the host and remote microphones are near to each other (such as shown in FIG. 8). In this case, when there is high level background noise present, even if the signal from sound source near the remote microphone is picked up by host microphone, it may be practically masked by background noise. Examples of this kind of situations are rock concerts and cocktail parties. In these cases where signal to noise estimators indicate high background noise level (or low SNR) both at host microphone and remote microphone, it may be beneficial to switch off the distance processing and use constant mixing level for remote microphone instead. Practically, in some embodiments this means boosting the remote microphone level in noisy conditions regardless of the distance between host and remote devices In some embodiments another case where constant mixing level may be used is when either or both remote and host microphones have good SNR, but correlation between these signals is low and the microphones are close to each other. This is usually a situation when remote and host microphones are in different acoustic spaces. For example in some embodiments the host is in a room near a closed door and the remote microphone is at the other side of the same door, but in another acoustic space.

It would be understood that in some embodiments the application of distance processing can be controlled based on multiple factors. For example the following table shows an example distance processing operation such as generated by the level control determiner 217 based on receiving a Signal to Noise Ratio (SNR) for the host (SNR Host) and the remote (SNR R) device microphones, the result of a correlation between the host and the remote device microphones and the distance between host and the remote devices. In the following example Boost R means generating a level control that boosts the remote mic signal more than a corresponding level control which is using only distance as a control factor (especially when the remote device is near the host) and X means either Near or Far. In different conditions and based on multiple factors a different mixing function can be used to define remote microphone gain. Constant mixing level is a one example of such a function. Decision to change distance processing function may be done when active audio signal is detected rather than when there is only background noise present.

| SNR Host | SNR R | Corr | Dist | Situations | Distance processing |
|---|---|---|---|---|---|
| High | H | H | X | Quiet environment | On |
| H | H | Low | Near | H and R in different acoustic spaces | Boost R |
| | | | Far | Two sources near devices or H and R far | On |
| H | L | H | X | Noise source near R mic | On |
| H | L | L | N | H and R in different acoustic spaces | Boost R |
| | | | F | Noise source near R mic or H and R in different acoustic spaces | On |
| L | H | H | X | Noise source near H mic | On |
| L | H | L | N | H and R in different acoustic spaces | Boost R |
| | | | F | Noise source near H mic or H and R in different acoustic spaces | On |
| L | L | H | X | Rock concert, correlated "background noise" | Boost R |
| L | L | L | X | Cocktail party, uncorrelated background noise | Boost R |

Figure 7:
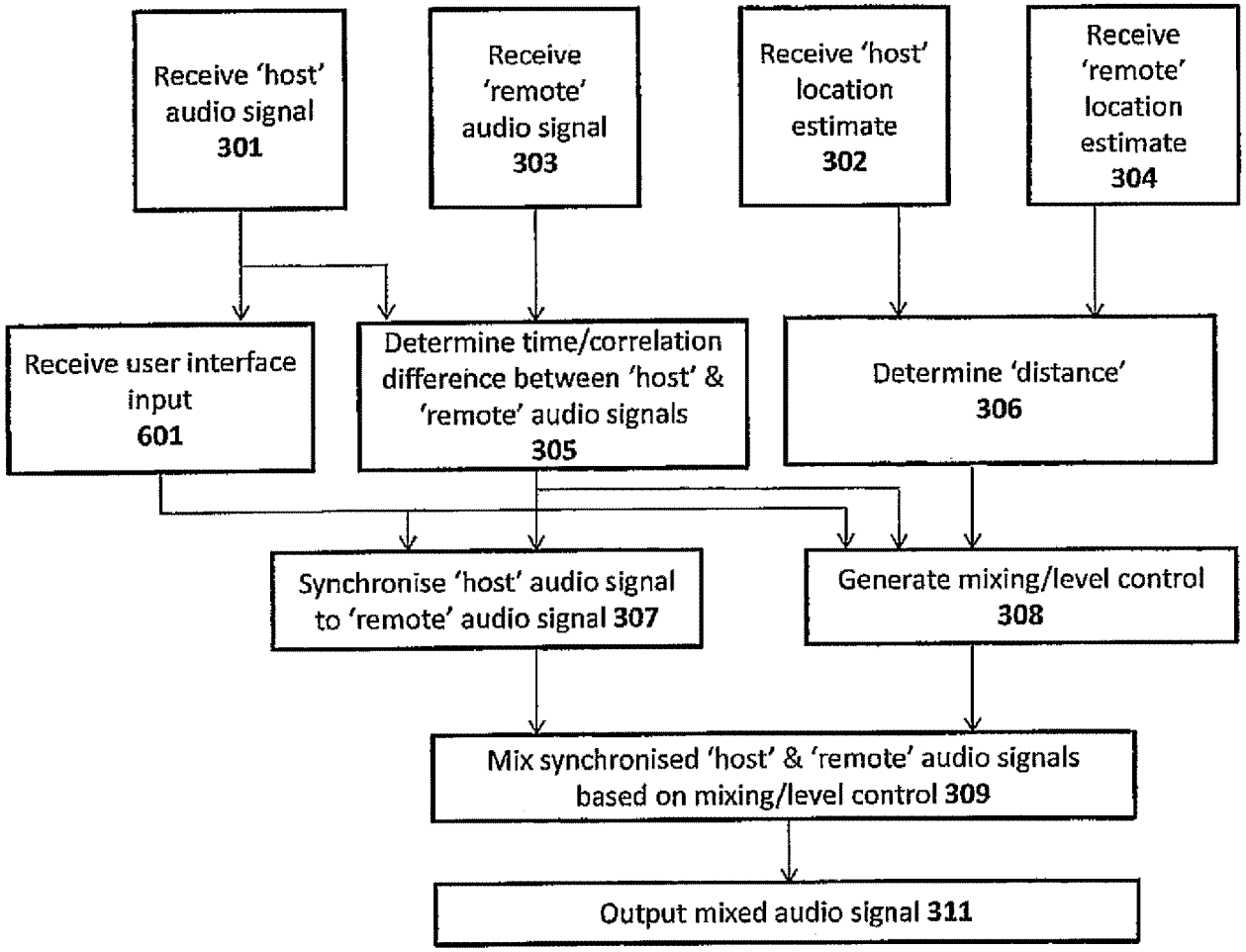
FIG. 7 shows schematically an additional flow diagram of the operation of the host apparatus shown in FIG. 3 employing user input, distance and correlation based mixing control according to some embodiments.

With respect to FIG. 7 a further flow diagram showing the operation of the host device according to some further embodiments is shown where there is optional user controllable elements.

In some embodiments the host device comprises a user interface comprising a display or suitable means for displaying images, as described herein and configured to display graphical images to the user. Furthermore in some embodiments the user interface comprises a user input or suitable means for providing a user input, such as a touch sensor or touch controller which in some embodiments operates in conjunction with the display to produce a touch screen display. The touch sensor or touch controller user input can in some embodiments be used to provide an additional input for (or control the operation of) the mixing operation. In some embodiments a visual representation or graphical representation is generated of the further apparatus or remote device and in some embodiments the visual representation or graphical representation is considered to be that of the at least one audio signal from the further apparatus or remote device. The User Interface may have switch to enable/disable distance based mixing for all remote microphones or individually for each microphone. In some embodiments the touch sensor or touch controller user input can be configured to provide user interface control to change between control curves or switch on and off distance based processing. In some embodiments the user input can be configured to select between control curve presets such as "noisy" and "quiet". In such embodiments selecting a "noisy" preset may switch off distance dependent level processing or use a control curve that is more suitable for noisy environment.

In some embodiments the relative host to remote location distance can be passed to the user interface. The user interface can in some embodiments be configured to generate a graphical representation of the relative host to remote location distance. For example a graphical icon can be generated at a position to be displayed on the display.

The display can then be configured to output the representation. Thus in some embodiments a graphical representation can be overlaid over the image captured by a camera displayed on the display indicating a visual representation of the remote device from the viewpoint of the host device. However the graphical representation can in some embodiments be any suitable format and as described herein can be a 'radar' map surrounding the host device, a map or plan of the area on which is displayed the graphical representation of the remote device.

In some embodiments the radar map can display a sector or part of the full surrounding environment, for example the sector visible by the camera image displayed on the screen and as such is affected by the camera depth of view.

In some embodiments the user interface can be configured to display a suitable direct-to-ambient ratio value which affects the level control determiner 217 value. For example by generating a slider user interface and displaying a direct to ambient level value a manual assistance to the determination of the level control values can be generated. This can be useful especially when the remote device or apparatus is at a 'mid' distance from the host. In such examples when the remote device (microphone) audio signal level is amplified and host audio signal (from remote microphone direction) is attenuated, then the audio source is given more presence. Correspondingly, when the remote device (microphone) audio signal level is attenuated and the directional level at host microphone is amplified, the source is given less presence. This arrangement may be employed and work fine when used with one remote microphone.

The reception of user interface input is shown in FIG. 7 by step 601.

Furthermore in some embodiments the user interface can be used to provide an input to enable the user to define where a specific audio source such as a speaker is heard with a virtual distance. For example in some embodiments the user interface can select a distance (2 meters away) from the host device which can be used by the level control determiner to generate a level control signal to produce a virtual distance between the apparatus regardless of the actual distance from the host device.

In implementations of the embodiments as described herein distributed conferencing taking place in large spaces (auditorium) permits the speech of participants that are in same space to be provided (for example by using a loudspeaker of the device or headset coupled to the device) to other participants that are in same space. When talker is near the listener, local amplification is not needed (since listener hears the speech via acoustic path) but as the talker moves further away the speech of the talker is played back from the listener's device to improve the speakers intelligibility. Thus, each listener would get an individually tailored level, based on how far they are from the talker.

Furthermore in some implementations of the embodiments described herein in multi device audio capture or recording when the speaker with a remote device or microphone is near a host device, the remote device (or microphone) level can be muted or mixed with a low level. When speaker moves further from the host device, the remote device (microphone) audio signal level is increased to pick up the speaker to enable good quality playback.

In such a manner some embodiments overcome the issues of when the speaker is near the host, the recording level may be too high when compared to sources without a remote device or microphone.

Furthermore by implementing the distance based mixing as described in some embodiments herein feedback in sound reproduction systems can be prevented where there are microphones and loudspeakers in same acoustic space. In such embodiments when a microphone gets too close the loudspeaker, the microphone level is attenuated to prevent feedback.

It would be understood that the user interface as described herein are example user interface implementations only.

It shall be appreciated that the term user equipment is intended to cover any suitable type of wireless user equipment, such as mobile telephones, portable data processing devices or portable web browsers, as well as wearable devices.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method comprising:

receiving at least one first audio signal from a first apparatus;

receiving at least one second audio signal from a second apparatus;

determining a distance between the first and the second apparatus;

generating a level control for mixing the at least one first audio signal and the at least one second audio signal based on the distance between the first and the second apparatus;

determining a correlation between the at least one first audio signal and the at least one second audio signal; and synchronizing one of the at least one first or at least one second audio signal to the other of the at least one second or at least one first audio signal respectively based on the correlation between the at least one first audio signal and the at least one second audio signal.

2. The method as claimed in claim 1, further comprising mixing the at least one first audio signal and the at least one second audio signal based on the level control.

3. The method as claimed in claim 1, wherein generating a level control for mixing the at least one first audio signal and the at least one second audio signal 25 based on the distance between the first and the second apparatus is further based on the correlation between the first audio signal and the at least one second signal.

4. The method as claimed in claim 1, further comprising determining a signal to noise ratio of the at least one first audio signal, wherein generating a level control for mixing the at least one first audio signal and the at least one second audio signal based on the distance between the first and the second apparatus is further based on the signal to noise ratio of the at least one first audio signal.

5. The method as claimed in claim 1, further comprising determining a signal to noise ratio of the at least one second audio signal, wherein generating a level control for mixing the at least one first audio signal and the at least one second audio signal based on the distance between the first and the second apparatus is further based on 5 the signal to noise ratio of the at least one second audio signal.

6. The method as claimed in claim 1, further comprising determining at least one user input, wherein generating a level control for mixing the at least one first audio signal and the at least one second audio signal based on the distance between the ID first and the second apparatus is further based on the at least one user input.

7. The method as claimed in claim 1, wherein determining a distance between the first and the second apparatus comprises:

determining a location estimation of the first apparatus;

determining a location estimation of the second apparatus;

determining a distance based on a location difference between the location estimation of the first apparatus and the location estimation of the second apparatus.

8. The method as claimed in claim 1, wherein determining a distance between the first and the second apparatus comprises the first apparatus determining a distance to the second apparatus or the second apparatus determining a distance to the first apparatus.

9. The method as claimed in claim 1, wherein generating a level control for mixing the at least one first audio signal and the at least one second audio signal based on the distance between the first and the second apparatus comprises generating a level control for mixing the at least one first audio signal and the at least one second audio signal such that the combined volume of the at least one first audio signal and the at least one second signal is substantially constant from a first distance between the first apparatus and the second apparatus and a second distance between the first apparatus and the second apparatus, wherein the first distance is smaller than the second distance.

10. The method as claimed in claim 1, wherein generating a level control for mixing the at least one first audio signal and the at least one second audio signal based on the distance between the first and the second apparatus comprises generating a level control for mixing the at least one first audio signal and the at least one second audio signal such that one of the at least one first audio signal and the at least one second audio signal is muted where the distance between the first apparatus and the second apparatus is less than a determined threshold distance.

11. The method as claimed in claim 1, wherein generating a level control for mixing the at least one first audio signal and the at least one second audio signal based on the distance between the first and the second apparatus comprises generating a level control for mixing the at least one first audio signal and the at least one second audio signal such that one of the at least one first audio signal and the at least one second audio signal is the most significant component when the distance between the first apparatus and the second apparatus is greater than a determined threshold distance.

12. The method as claimed in claim 1, wherein receiving at least one first audio signal from a first apparatus comprises receiving the at least one first audio signal from a microphone that is proximate to the first apparatus and receiving at least one second audio signal from a second apparatus comprises receiving the at least one second audio signal from a microphone that is remote from the first apparatus.

13. An apparatus comprising at least one processor and at least one memory including computer code for one or more programs, the at least one memory and the computer code configured to with the at least one processor cause the apparatus to at least:

receive at least one first audio signal from a first apparatus;

receive at least one second audio signal from a second apparatus;

determine a distance between the first and the second apparatus;

generate a level control to mix the at least one first audio signal and the at least one second audio signal based on the distance between the first and the second apparatus;

determine a correlation between the at least one first audio signal and the at least one second audio signal; and synchronize one of the at least one first or at least one second audio signal to the other of the at least one second or at least one first audio signal respectively based on the correlation between the at least one first audio signal and the at least one second audio signal.

14. The apparatus as claimed in claim 13, further caused to mix the at least one first audio signal and the at least one second audio signal based on the level control.

15. The apparatus as claimed in claim 13, wherein the level control to mix the at least one first audio signal and the at least one second audio signal based on the distance between the first and the second apparatus is further based on the correlation between the first audio signal and the at least one second signal.

16. The apparatus as claimed in claim 13, further caused to determine a signal to noise ratio of the at least one first audio signal, wherein the level control to mix the at least one first audio signal and the at least one second audio signal based on the distance between the first and the second apparatus is further based on the signal to noise ratio of the at least one first audio signal.

* * * * *